US012532915B2

(12) United States Patent
Lee et al.

(10) Patent No.: US 12,532,915 B2
(45) Date of Patent: Jan. 27, 2026

(54) AEROSOL-GENERATING DEVICE

(71) Applicant: KT&G CORPORATION, Daejeon (KR)

(72) Inventors: Jongsub Lee, Sungnam-si (KR); Minkyu Kim, Seoul (KR); Jueon Park, Seoul (KR); Byungsung Cho, Gwangmyung-si (KR); Sungrok Oh, Gunpo-si (KR)

(73) Assignee: KT&G CORPORATION, Daejeon (KR)

( * ) Notice: Subject to any disclaimer, the term of this patent is extended or adjusted under 35 U.S.C. 154(b) by 530 days.

(21) Appl. No.: 17/797,050

(22) PCT Filed: Nov. 22, 2021

(86) PCT No.: PCT/KR2021/017181
§ 371 (c)(1),
(2) Date: Aug. 2, 2022

(87) PCT Pub. No.: WO2022/114702
PCT Pub. Date: Jun. 2, 2022

(65) Prior Publication Data

US 2023/0063531 A1 Mar. 2, 2023

(30) Foreign Application Priority Data

Nov. 24, 2020 (KR) ..... 10-2020-0159112

(51) Int. Cl.
*A24F 40/42* (2020.01)
*A24F 40/30* (2020.01)
*A24F 40/46* (2020.01)

(52) U.S. Cl.
CPC ..... *A24F 40/42* (2020.01); *A24F 40/30* (2020.01); *A24F 40/46* (2020.01)

(58) Field of Classification Search
None
See application file for complete search history.

(56) References Cited

U.S. PATENT DOCUMENTS

2004/0025871 A1* 2/2004 Davies ..... A61M 15/0068 128/203.15
2019/0208811 A1* 7/2019 Biel ..... A24F 40/42
(Continued)

FOREIGN PATENT DOCUMENTS

CN 106231929 12/2016
CN 109757781 5/2019
(Continued)

OTHER PUBLICATIONS

CN111387554A, Electronic cigarette, (Year: 2020).*
(Continued)

*Primary Examiner* — Manley L Cummins, IV
(74) *Attorney, Agent, or Firm* — LEE, HONG, DEGERMAN, KANG & WAIMEY

(57) ABSTRACT

An aerosol-generating device is disclosed. The aerosol-generating device includes a cartridge, which includes a first container and a second container includes a plurality of chambers isolated from each other, and is rotatably coupled to the first container, a housing, which has a reception space into which the cartridge is inserted, a dial gear, which is disposed in the housing, includes a rotating shaft parallel to a rotating shaft of the second container, and rotatably engages with the second container, and a battery, which is disposed in the housing adjacent both to the dial gear and to the reception space in a longitudinal direction of the rotating shaft of the dial gear.

11 Claims, 6 Drawing Sheets

(56) References Cited

U.S. PATENT DOCUMENTS

| | | | | |
|---|---|---|---|---|
| 2019/0208817 | A1* | 7/2019 | Qiu | A24F 40/485 |
| 2019/0289909 | A1* | 9/2019 | Hejazi | A24F 40/42 |
| 2019/0307168 | A1 | 10/2019 | Zhao et al. | |
| 2019/0307173 | A1 | 10/2019 | Qiu | |
| 2021/0298362 | A1* | 9/2021 | Woodbine | A61M 15/009 |

FOREIGN PATENT DOCUMENTS

| | | | |
|---|---|---|---|
| CN | 111387554 | | 7/2020 |
| EP | 3692825 | | 8/2020 |
| KR | 1020190104616 | | 9/2019 |
| KR | 20200007475 | | 1/2020 |
| KR | 1020200130442 | | 11/2020 |
| KR | 20210100405 | A * | 8/2021 |
| WO | 2015013329 | | 1/2015 |
| WO | 2020223875 | | 11/2020 |
| WO | 2021241932 | | 12/2021 |
| WO | 2021261786 | | 12/2021 |
| WO | 2022010224 | | 1/2022 |
| WO | 2022050677 | | 3/2022 |
| WO | 2022065677 | | 3/2022 |

OTHER PUBLICATIONS

KR20210100405A, Aerosol delivering device and aerosol generating device with the same, (Year: 2021).*

JP2004159675A, Perfume Suction Pipe, (Year: 2004).*

PCT International Application No. PCT/KR2021/017181, International Search Report dated Mar. 2, 2022, 3 pages.

Korean Intellectual Property Office Application No. 10-2020-0159112, Office Action dated Nov. 18, 2022, 3 pages.

Korean Intellectual Property Office Application No. 10-2020-0159112, Notice of Allowance dated May 2, 2023, 2 pages.

The State Intellectual Property Office of the People's Republic of China Application Serial No. 202180011941.3, Office Action dated May 31, 2024, 9 pages.

European Patent Office Application Serial No. 21898528.1, Search Report dated Dec. 6, 2024, 17 pages.

* cited by examiner

【FIG. 1】
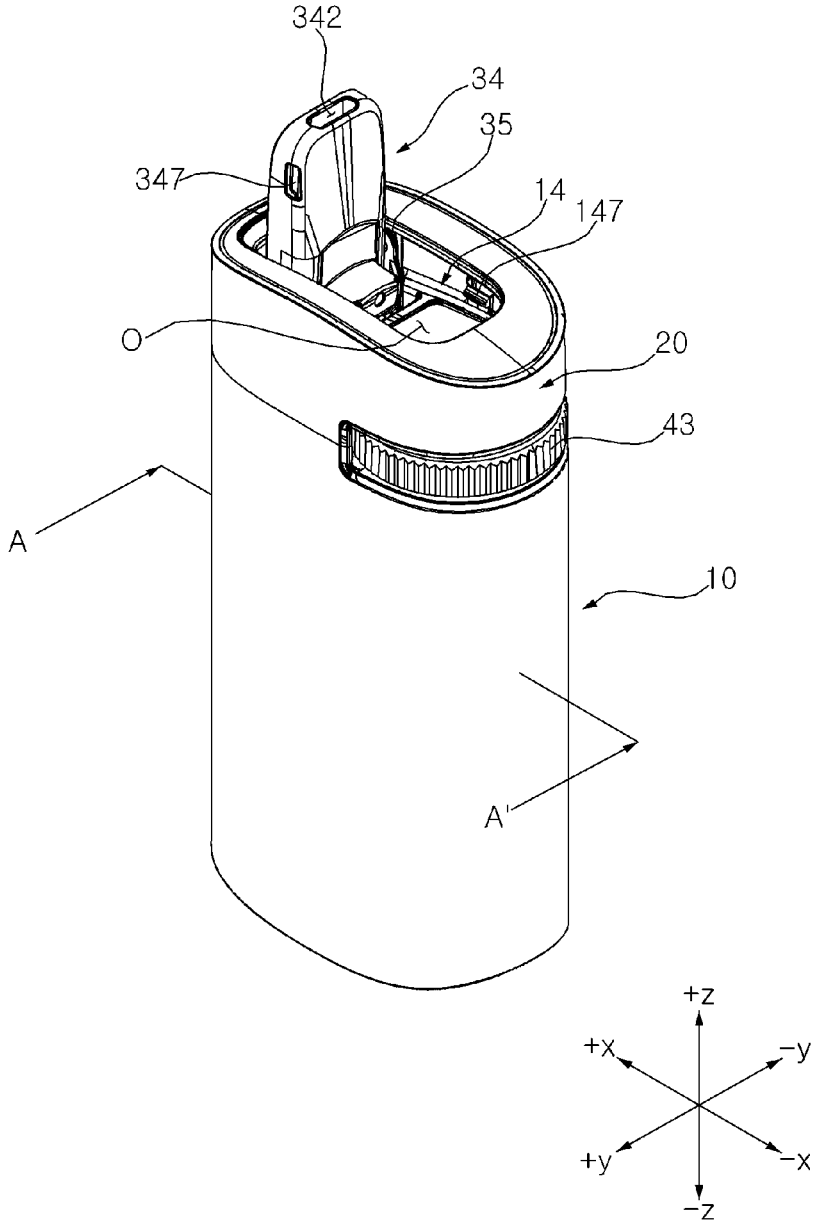

【FIG. 2】
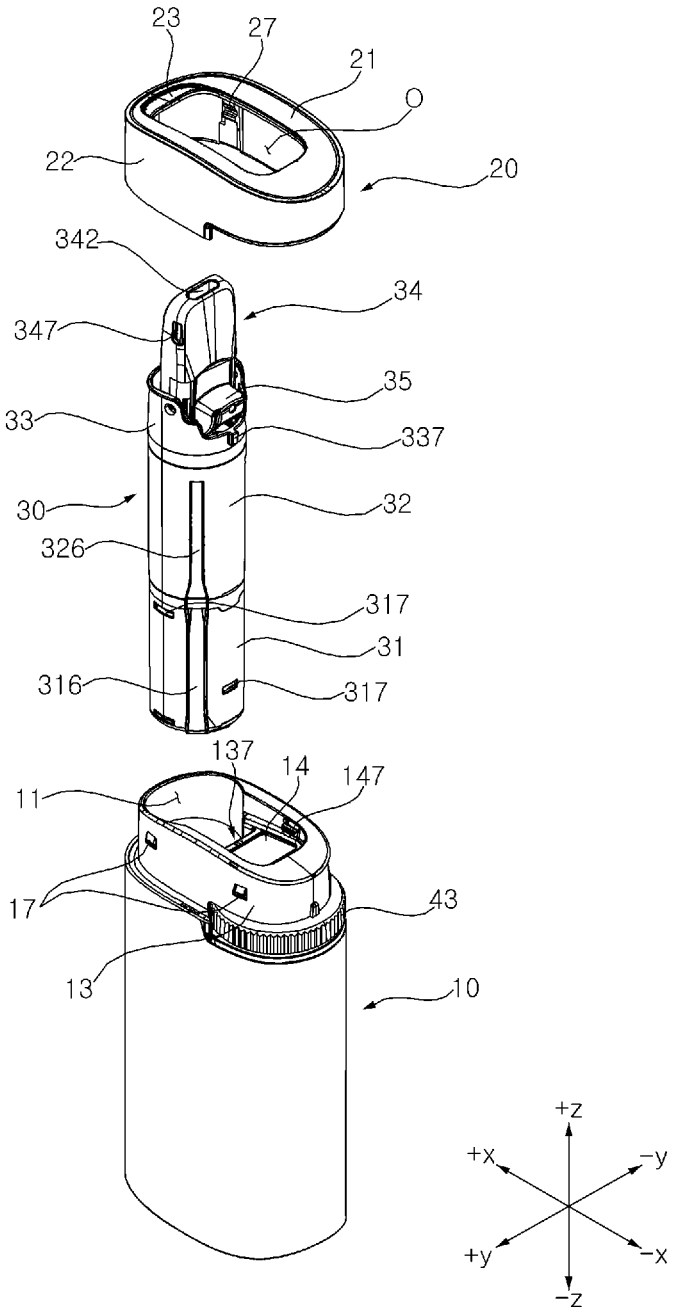

【FIG. 3】
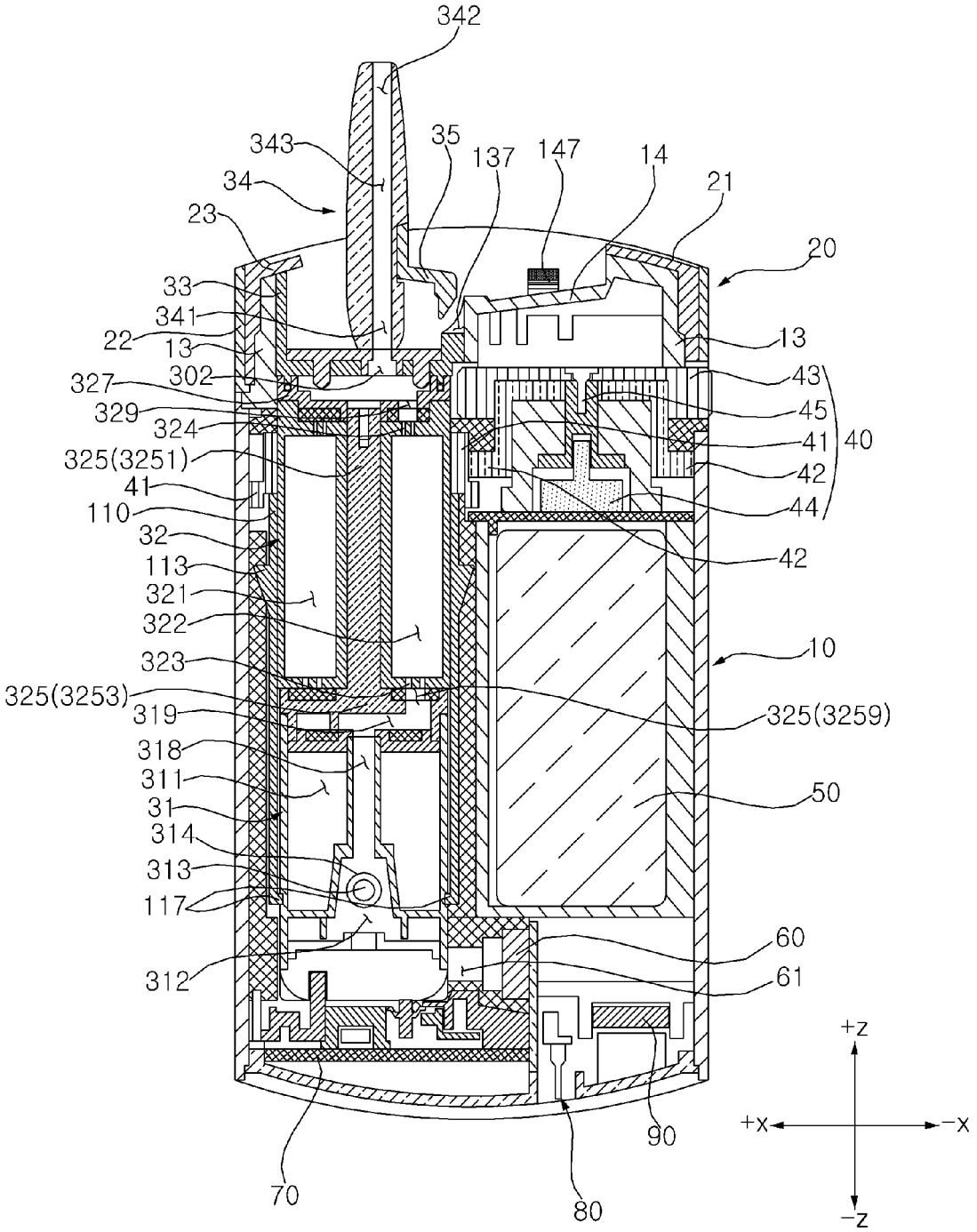

【FIG. 4】
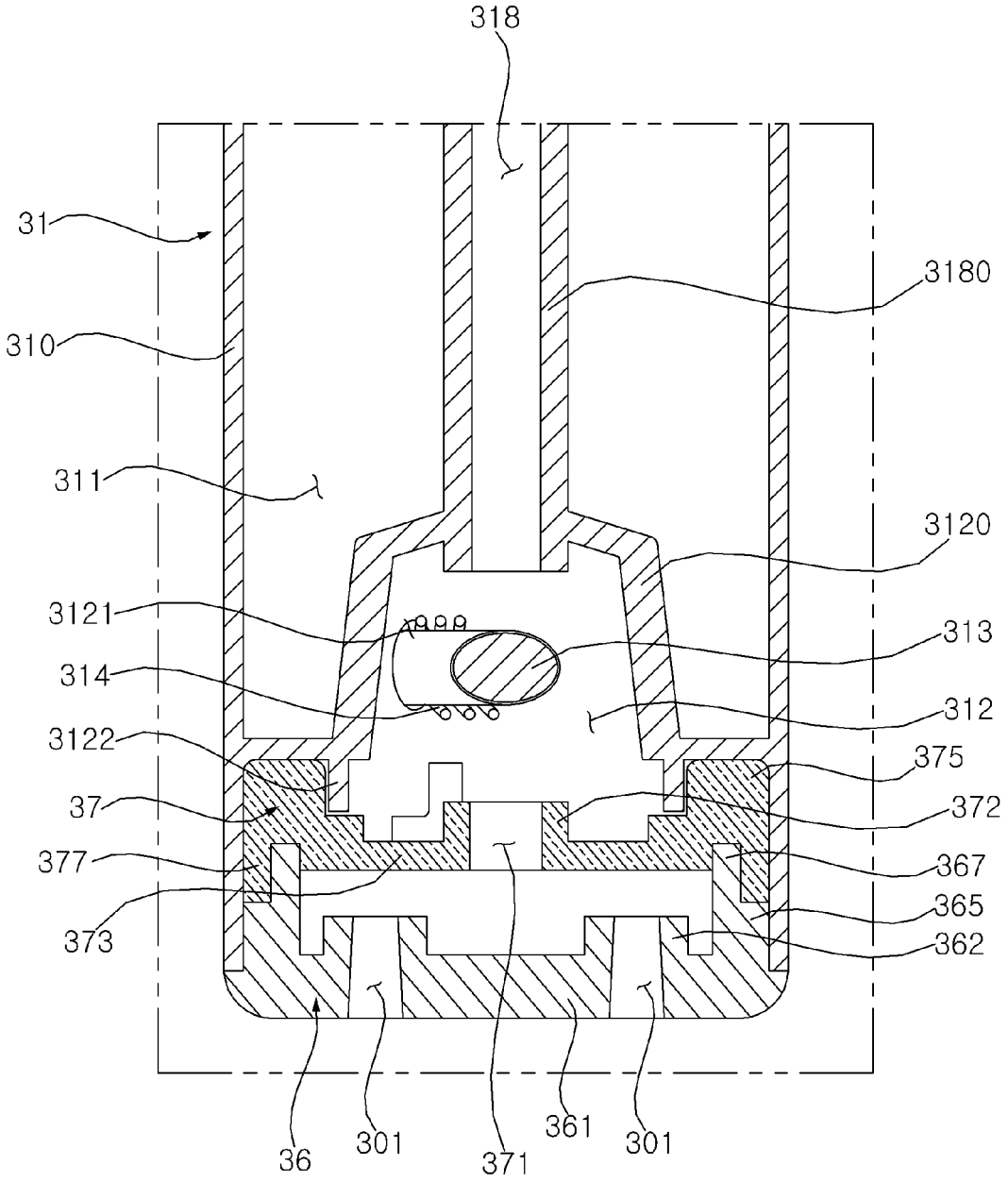

【FIG. 5】
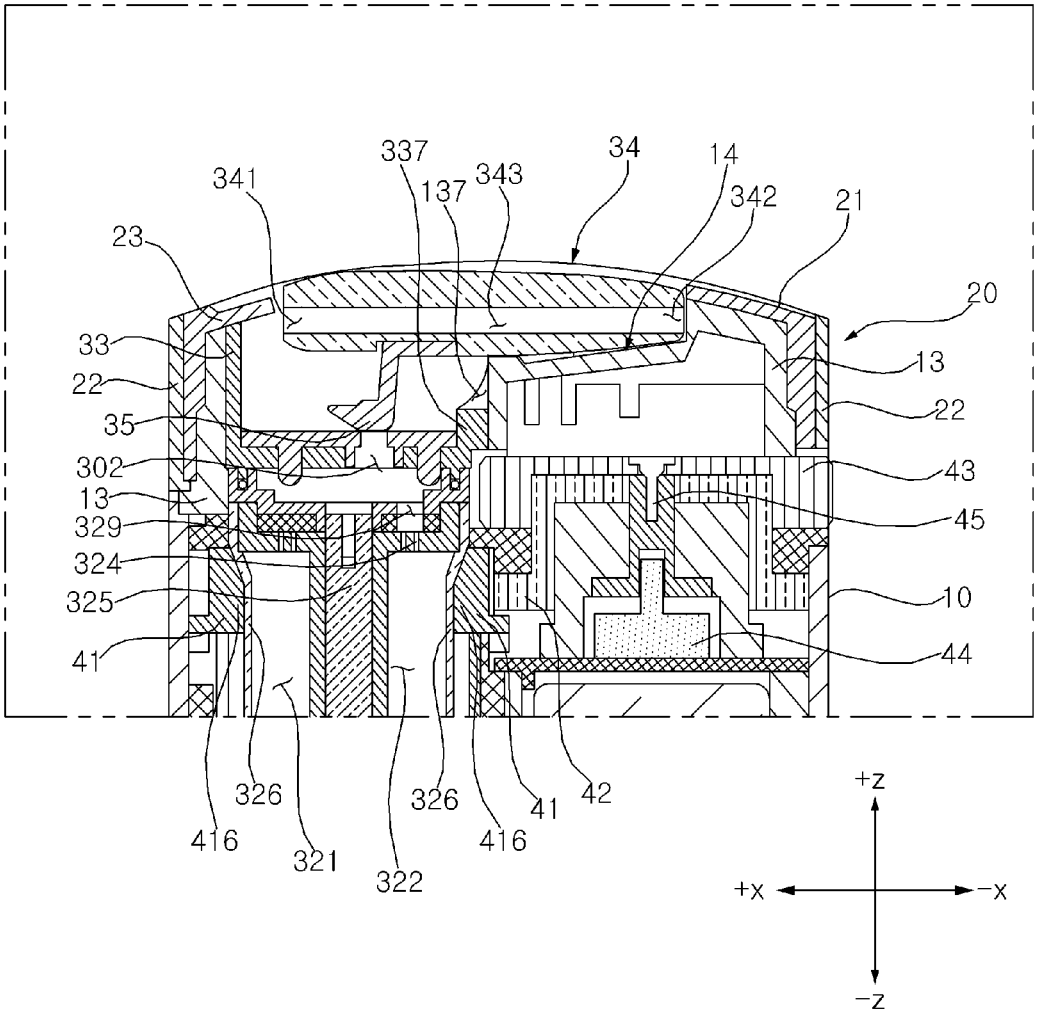

【FIG. 6】
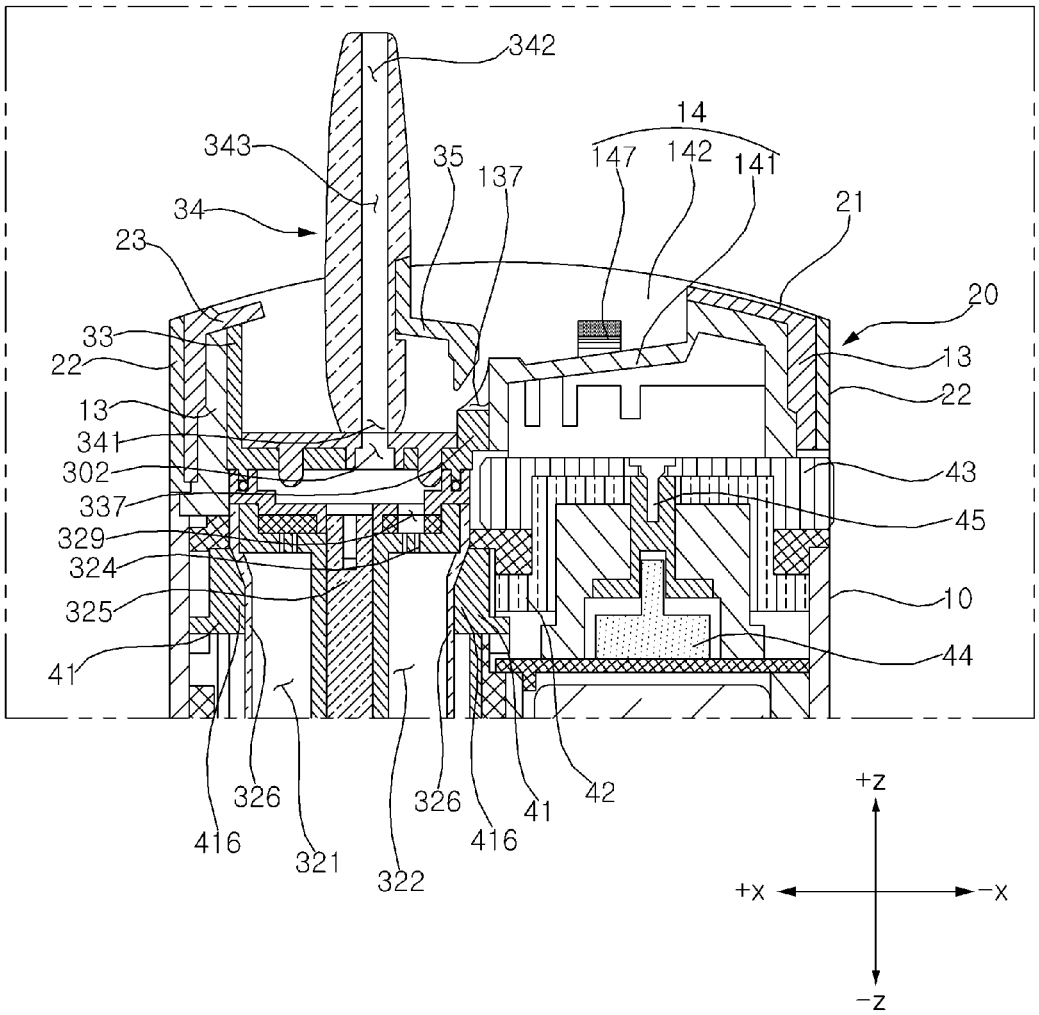

AEROSOL-GENERATING DEVICE

CROSS-REFERENCE TO RELATED APPLICATIONS

This application is the National Stage filing under 35 U.S.C. 371 of International Application No. PCT/KR2021/017181, filed on Nov. 22, 2021, which claims the benefit of earlier filing date and right of priority to Korean Application No. 10-2020-0159112, filed on Nov. 24, 2020, the contents of which are all hereby incorporated by reference herein their entirety.

TECHNICAL FIELD

The present disclosure relates to an aerosol-generating device.

BACKGROUND ART

An aerosol-generating device is a device that extracts certain components from a medium or a substance by forming an aerosol. The medium may contain a multicomponent substance. The substance contained in the medium may be a multicomponent flavoring substance. For example, the substance contained in the medium may include a nicotine component, an herbal component, and/or a coffee component. Recently, various research on aerosol-generating devices has been conducted.

DISCLOSURE OF INVENTION

Technical Problem

It is an object of the present disclosure to provide an aerosol-generating device that prevents the length thereof from being unnecessarily increased even when the volume of a battery is increased in order to increase the capacity of the battery and which has a compact structure suitable for a user's hand.

It is another object of the present disclosure to provide an aerosol-generating device that has a compact structure and ensures space for accommodating therein various components.

It is still another object of the present disclosure to provide an aerosol-generating device that enables a used medium to be easily replaced with a fresh medium without dismounting or replacing a cartridge when the medium is deteriorated due to prolonged use.

It is yet another object of the present disclosure to provide an aerosol-generating device that prevents a medium and/or material for vaporization from decomposing due to exposure to external air and maintains the optimal quality thereof.

Solution to Problem

In accordance with an aspect of the present invention for accomplishing the above and other objects, there is provided an aerosol-generating device including a cartridge including a first container and a second container, wherein the second container includes a plurality of chambers isolated from each other, and is rotatably coupled to the first container; a housing, which has a reception space into which the cartridge is inserted; a dial gear, which is disposed in the housing, includes a rotating shaft parallel to a rotating shaft of the second container, and rotatably engages with the second container; and a battery, which is disposed in the housing adjacent both to the dial gear and to the reception space in a longitudinal direction of the rotating shaft of the dial gear.

Advantageous Effects of Invention

According to at least one of embodiments of the present disclosure, the aerosol-generating device is capable of preventing the length thereof from being unnecessarily increased even when the volume of a battery is increased in order to increase the capacity of the battery and of having a compact structure suitable for a user's hand.

In addition, according to at least one of embodiments of the present disclosure, the aerosol-generating device is capable of having a compact structure and of ensuring a space for accommodating therein various components.

In addition, according to at least one of embodiments of the present disclosure, the aerosol-generating device is capable of allowing a used medium to be easily replaced with a fresh medium without dismounting or replacing a cartridge.

In addition, according to at least one of embodiments of the present disclosure, the aerosol-generating device is capable of preventing a medium and/or material for vaporization from decomposing due to exposure to external air.

Additional applications of the present disclosure will become apparent from the following detailed description. However, because various changes and modifications that fall within the spirit and scope of the present disclosure will be readily apparent to those skilled in the art, it should be understood that the detailed description and specific embodiments, including preferred embodiments of the present disclosure, are merely given by way of example.

BRIEF DESCRIPTION OF DRAWINGS

The above and other objects, features and other advantages of the present disclosure will be more clearly understood from the following detailed description taken in conjunction with the accompanying drawings, in which:

FIGS. 1 to 6 are views illustrating an aerosol-generating device according to an embodiment of the present disclosure.

MODE FOR THE INVENTION

A description will now be given in detail according to exemplary embodiments disclosed herein, with reference to the accompanying drawings. For the sake of brevity of description with reference to the drawings, the same or equivalent components are denoted by the same reference numbers, and a description thereof will not be repeated.

In general, suffixes such as "module" and "unit" may be used to refer to elements or components. The use of such suffixes herein is merely intended to facilitate description of the specification, and the suffixes do not have any special meaning or function.

In the present disclosure, that which is well known to one of ordinary skill in the relevant art has generally been omitted for the sake of brevity. The accompanying drawings are used to facilitate understanding of various technical features, and it should be understood that the embodiments presented herein are not limited by the accompanying drawings. As such, the present disclosure should be construed to extend to any alterations, equivalents and substitutes, in addition to those that are particularly set out in the accompanying drawings.

It is to be understood that, although the terms "first," "second," etc. may be used herein to describe various elements, these elements should not be limited by these terms. These terms are only used to distinguish one element from another.

It will be understood that when an element is referred to as being "connected with" another element, intervening elements may be present. In contrast, it will be understood that when an element is referred to as being "directly connected with" another element, there are no intervening elements present.

A singular representation may include a plural representation unless the context clearly indicates otherwise.

Hereinafter, directions of an aerosol-generating device are defined based on the orthogonal coordinate system shown in FIGS. 1 to 3, 5 and 6. In the orthogonal coordinate system, the x-axis direction may be defined as the right and left direction of the aerosol-generating device. Here, based on the origin, the +x-axis direction may mean the leftward direction, and the −x-axis direction may mean the rightward direction. Furthermore, the y-axis direction may be defined as the forward and backward direction of the aerosol-generating device. Here, based on the origin, the +y-axis direction may mean the forward direction, and the −y-axis direction may mean the backward direction. In addition, the z-axis direction may be defined as the upward and downward direction of the aerosol-generating device. Here, based on the origin, the +z-axis direction may mean the upward direction, and the −z-axis direction may mean the downward direction.

Referring to FIGS. 1 and 2, a housing 10 may be provided therein with a reception space 11, and may be open at one surface thereof Δn upper case 20 may be mounted on the upper portion of the housing 10 (hereinafter, referred to as an upper housing 13). The upper case 20 may surround the upper housing 13. The upper case 20 may be perforated vertically so as to define an opening O therein. The opening O may communicate with the reception space 11. A cartridge 30 may be inserted into the reception space 11 defined in the housing 10. An aerosol may be generated in the cartridge 30, and may be discharged to the outside through the inside of the cartridge 30.

The opening O may be formed in the upper surface 21 of the upper case 20. The upper surface 21 of the upper case 20 may be disposed over the housing 10. The side surface 22 of the upper case 20 may extend along the circumference of the upper surface 21. A head cover 23, which is a portion of the upper surface 21 of the upper case 20, may cover the upper portion of a container head 33.

A mounting groove 27 may be formed in the inner side of the side surface 22. A mounting protrusion 17 may project outwards from the upper housing 13 so as to be fitted into the mounting groove 27. The mounting protrusion 17 and the mounting groove 27 may be formed at positions corresponding to each other. Each of the mounting protrusion 17 and the mounting groove 27 may include a plurality of mounting protrusions or grooves.

The cartridge 30 may include a first container 31 and a second container 32. For example, the first container 31 may have therein a chamber configured to contain a liquid therein. The second container 32 may have therein a chamber configured to contain a medium. The second container 32 may be rotatably connected or coupled to the first container 31. The second container 32 may be disposed on the first container 31. The first container 31 and the second container 32 may have approximately the same diameter.

A first guide slit 316 may be formed in the outer circumferential surface of the first container 31. The first guide slit 316 may be depressed inwards from the outer circumferential surface of the first container 31. The first guide slit 316 may be formed so as to extend vertically. The first guide slit 316 may extend to the lower end from the upper end of the outer circumferential surface of the first container 31. the outer circumferential surface of the first container 31 may be referred to as an outer facing surface of the first container 31 or an outer surface of the first container 31.

The second guide slit 326 may be formed in the outer circumferential surface of the second container 32. The second guide slit 326 may be depressed inwards from the outer circumferential surface of the second container 32. The second guide slit 326 may be formed so as to extend vertically. The second guide slit 326 may extend to the lower end of the outer circumferential surface of the second container 32 from a predetermined vertical position thereof the outer circumferential surface of the second container 32 may be referred to as an outer facing surface of the second container 32 or an outer surface of the second container 32.F When the second container 32 rotates to a predetermined position, the second guide slit 326 may be aligned with the first guide slit 316. At this position, the lower end of the second guide slit 326 may be connected to the upper end of the first guide slit 316.

The second guide slit 326 may include a portion that is increasingly wide downwards. The second guide slit 326 may be widest at the lower end of the second container 32. The width of the second guide slit 326 may increase upwards from the lower end of the second guide slit 326, and may be maintained at a certain value from a predetermined height. The lower end of the second guide slit 326 may be the same width as the width of the upper end of the first guide slit 316. The width of the first guide slit 316 may be greatest at the lower end and/or the upper end thereof.

The first guide slit 316 may include a plurality of first guide slits, which are arranged along the circumference of the first container 31. The second guide slit 326 may include a plurality of second guide slits, which are arranged along the circumference of the second container 32.

Each of the first and second guide slits 316 and 326 may be referred to as a guide channel or a guide groove.

A holding groove 317 may be formed so as to be depressed inwards from the outer circumferential surface of the first container 31. The holding groove 317 may be formed at a position that is spaced apart from the first guide slit 316. A holding protrusion 117, which is provided at a lower portion of the reception space 11, may be fitted into the holding groove 317 (see FIG. 3).

The cartridge 30 may include the container head 33, which is positioned on the second container 32. The container head 33 may extend upwards from the outer circumferential surface of the second container 32. The container head 33 may be configured such that the upper portion thereof is open. The container head 33 may be open at a portion of the side surface portion thereof. The container head 33 may be configured such that the upper surface portion and the side surface portion thereof are continuously opened so as to form an "L"-shaped opening.

A fitting protrusion 337 may be formed so as to project outwards from one side surface of the container head 33. The fitting protrusion 337 may be inserted into a fitting groove 137 formed in the upper portion of the reception space 11 (see FIG. 5).

The cartridge 30 may include a mouthpiece 34, which is pivotably connected or coupled to the container head 33.

The mouthpiece 34 may have formed therein a suction passage 343 (see FIG. 3). The suction passage 343 may communicate both with a second inlet 341 and with a second outlet 342 (see FIG. 5). For convenience of explanation, the suction passage 343 may be referred to as a passage 343 or a second passage 343.

The mouthpiece 34 may be exposed to the outside from the open portion of the container head 33. When the mouthpiece 34 is inserted into the reception space 11, the mouthpiece 34 may be exposed to the outside through the opening O in the upper case 20. The mouthpiece 34 may have a shape corresponding to the opening O. The mouthpiece 34 may be pivotable in the opening O.

A sealing cap 35 may project outwards from the mouthpiece 34. The sealing cap 35 may be coupled to one side of the mouthpiece 34. The sealing cap 35 may be oriented so as to project in the direction in which the mouthpiece 34 is pivoted.

A seating portion 14 may be formed in the upper housing 13. The seating portion 14 may be depressed downwards from the upper housing 13. The seating portion 14 may have a shape corresponding to the mouthpiece 34. When the mouthpiece 34 is pivoted to a certain position while the cartridge 30 is disposed in the reception space 11, the mouthpiece 34 may be seated and received in the seating portion 14.

A holding groove 347 may be formed so as to be depressed inwards from the side surface of the mouthpiece 34. A holding protrusion 147 may project inwards from the side surface of the seating portion 14. The holding protrusion 147 may be removably fitted into the holding groove 347. When the mouthpiece 34 is pivoted and seated in the seating portion 14, the holding protrusion 147 may be inserted into the holding groove 347 such that the mouthpiece 34 is held in the seated position. When the mouthpiece 34 is pivoted in the opposite direction, the holding protrusion 147 may be disengaged from the holding groove 347 such that the mouthpiece 34 becomes separable from the seating portion 14.

A dial 43 may be rotatably disposed in the housing 10. At least a portion of the dial 43 may be exposed to the outside from the housing 10. The dial 43 may be disposed adjacent to the upper housing 13. The dial 43 may be rotated in order to rotate the second container 32.

Referring to FIG. 3, the cartridge 30 may be inserted vertically in the reception space 11 (see FIG. 2) in the housing 10. A battery 50 may be received in the housing 10 so as to be disposed parallel to the reception space 11. A gear assembly 40 may be received in the housing 10 so as to be disposed over the battery 50. The seating portion 14 may be oriented parallel to the reception space 11. The seating portion 14 may be disposed over the battery 50.

The first container 31 may include therein a liquid chamber 311 and an evaporation chamber 312. A material for vaporization may be received in the liquid chamber 311. A wick 313 may be disposed in the evaporation chamber 312. The wick 313 may be formed so as to extend in a forward and backward direction. A heater 314 may be disposed in the evaporation chamber 312. The heater 314 may be disposed around the wick 313 so as to heat the wick 313. The heater 314 may be configured so as to have the form of a coil surrounding the wick 313.

The material for vaporization may be absorbed into the wick 313 from the liquid chamber 311, and may then be introduced into the evaporation chamber 312. The heater 314 may heat the wick 313 to thereby evaporate the material for vaporization absorbed in the wick 313 and thus generate an aerosol. An evaporation passage 318 may communicate with the evaporation chamber 312. The evaporation passage 318 may be formed above the evaporation chamber 312. The evaporation passage 318 may be positioned over the wick 313 and the heater 314. The evaporation passage 318 may be oriented in the longitudinal direction of a container shaft 325, which is disposed vertically.

The second container 32 may include a plurality of chambers 321 and 322, which are isolated from each other. The plurality of chambers 321 and 322 may be respectively referred to as a first granulation chamber 321 and a second granulation chamber 322. Hereinafter, although only the first and second granulation chambers 321 and 322 will be described for convenience of explanation, the second container 32 may include a plurality of chambers 321, 322, . . . , which are isolated from each other, without limiting the number thereof. For example, the plurality of chambers 321, 322, . . . may include four chambers.

The second container 32 may be rotated about the container shaft 325, which is oriented vertically. The plurality of chambers 321 and 322 may be arranged in the rotational direction of the second container 32. The medium may be received in the plurality of chambers 321 and 322. The container shaft 325 may be referred to as a rotating shaft of the second container 32.

A lower chamber hole 323 may be formed in the lower portion of the first granulation chamber 321. The lower chamber hole 323 may be formed in the lower portion of the second granulation chamber 322. An upper chamber hole 324 may be formed in the upper portion of the first granulation chamber 321. The upper chamber hole 324 may be formed in the upper portion of the second granulation chamber 322.

The first container 31 and the second container 32 may be connected to each other via a first connecting passage 319. The first connecting passage 319 may be positioned between the first container 31 and the second container 32. The first connecting passage 319 may be positioned over the evaporation passage 318 so as to communicate with the evaporation passage 318.

When the second container 32 is rotated, the first connecting passage 319 may be connected to one of the plurality of chambers 321 and 322 in the second container 32. The first connecting passage 319 may be connected to the lower chamber hole 323 formed in the lower portion of the first granulation chamber 321. The first connecting passage 319 may be connected to the lower chamber hole 323 formed in the lower portion of the second granulation chamber 322.

Among the plurality of chambers, the remaining chamber or chambers (hereinafter, referred to as a remaining chamber), which is not connected to the first connecting passage 319, may be hermetically closed so as to prevent the entry of external air. The chamber 5 holes in the remaining chamber may be closed.

A first inlet 301 (see FIG. 4) may be formed in the lower portion of the first container 31, and a first outlet 302 may be formed in the upper portion of the second container 32. The first inlet 310 may communicate with the evaporation chamber 312. The evaporation chamber 312 may be positioned over the first inlet 301. The first outlet 302 may communicate with the upper chamber hole 324. The first outlet 302 may be positioned over the upper chamber hole 324. A second connecting passage 329 (see FIG. 5) may be connected to the first outlet 302 and the upper chamber hole 324. The second connecting passage 329 may be positioned between the first outlet 302 and the upper chamber hole 324. The first outlet 302 may face the second inlet 341 so as to communicate with the suction passage 343. A user may inhale air through the mouthpiece 34. Air may be discharged upwards through the first outlet 302. The passage formed in the cartridge 30 may be referred to as a first passage or a cartridge passage. The first passage may communicate with the first inlet 301 and the first outlet 302. The air that is introduced through the first inlet 301 may be discharged from the first outlet 302 through the first passage. The first passage may be formed by connecting one of the plurality of chambers in the second container 32 to the passage formed in the first container 31.

When the cartridge 30 is inserted into the reception space 11, the head cover 23 of the upper case 20 may be disposed over the container head 33. The head cover 23 may cover the upper portion of the container head 33.

Consequently, it is possible to prevent the cartridge 30 from escaping outwards from the reception space 11.

The holding protrusion 117 may be disposed at the lower portion of the reception space 11, and may project toward the inside of the reception space 11. When the cartridge 30 is inserted into the reception space 11, the holding protrusion 117 may be fitted into the holding groove 317 (see FIG. 2).

Consequently, when the second container 32 is rotated in the reception space 11, the first container may be held in place without being rotated together with the second container 32.

The fitting groove 137 may be formed in the upper side of the reception space 11. When the cartridge 30 is inserted into the reception space 11, the fitting protrusion 337 may be fitted into the fitting groove 137 (see FIG. 5).

Accordingly, when the cartridge 30 is inserted into the reception space 11, a user is able to dispose the cartridge 30 at the correct position.

Consequently, when the second container 32 is rotated in the reception space 11, the container head 33 may be held in place without being rotated together with the second container 32.

The gear assembly 40 may rotate the second container 32. The gear assembly 40 may be mounted in the housing 10. The gear assembly 40 may include at least one of a cartridge gear 41, a dial gear 42, and the dial 43.

The dial gear 42 may be mounted in the housing 10. The dial gear 42 may include a rotating shaft, which is parallel to the rotating shaft of the second container 32. The rotating shaft of the dial gear 42 and/or the rotating shaft of the dial 43 may be referred to as a dial shaft 45. The dial shaft 45 of the dial gear 42 may be oriented parallel to the container shaft 325. The dial gear 42 may be disposed over the battery 50. The dial gear 42 may be disposed adjacent to the side surface of the cartridge 30. The dial gear 42 may be disposed adjacent to the side surface of the second container 32.

The dial gear 42 may be rotated by rotating the dial 43. The dial gear 42 may be rotated by receiving power from a motor (not shown).

The dial gear 42 may be rotated while being engaged with the second container 32. The dial gear 42 may be rotated while being directly engaged with the outer circumferential surface of the second container 32.

The cartridge gear 41 may be rotatably mounted in the housing 10. The cartridge gear 41 may be positioned coaxially with the second container 32.

The cartridge gear 41 may be configured to have the form of a ring, the inner circumferential surface of which defines therein a space. The inner circumferential surface of the cartridge gear 41 may be configured to surround the reception space 11. The inner circumferential surface of the cartridge gear 41 may be engaged with the outer circumferential surface of the second container 32 so as to rotate therewith. The dial gear 42 may be engaged with the outer circumferential surface of the cartridge gear 41 so as to rotate therewith. the inner circumferential surface of the cartridge gear 41 may be referred to as an inner facing surface of the cartridge gear 41 or an inner surface of the cartridge gear 41.

The dial 43 may be mounted in the housing 10. At least a portion of the dial 43 may be exposed to the outside from the housing 10. The dial 43 may be positioned coaxially with the dial gear 42. The dial 43 may be rotated together with the dial gear 42 about the dial shaft 45. The dial shaft 45 may be disposed parallel to the container shaft 325.

Consequently, a user is able to rotate the second container 32 by rotating the dial 43 at the outside of the housing 10.

The dial 43 may be mounted to the upper housing 13. The dial 43 may be mounted over the battery 50.

Consequently, a user is able to conveniently rotate the dial 43 while gripping the aerosol-generating device.

A rotary switch 44 may be mounted coaxially with the dial gear 42 and/or the dial 43. The rotary switch 44 may be disposed over the battery 50. The rotary switch 44 may detect the rotational position of the dial gear 42 and/or the dial 43 and may thus detect the position of the second container 32.

A controller 70 may determine with which of the plurality of granulation chambers the first connecting passage 319 and the first outlet 302 communicate using the rotary switch 44.

The battery 50 may be disposed at the lateral side of the reception space 11. The battery 50 may be disposed parallel to the reception space 11 and/or the cartridge 30. The battery 50 may be disposed adjacent to the dial gear 42 and the reception space 11 in the longitudinal direction of the rotating shaft of the dial gear 42.

Accordingly, even when the volume of the battery 50 is increased in order to increase the capacity of the battery 50, the aerosol-generating device may have a compact structure suitable for being held in a user's hand without unnecessarily increasing the length thereof.

Consequently, it is possible to ensure spaces for accommodating therein the gear assembly 40, the seating portion 14, a flow sensor 60, a vibration motor and the like above and below the battery 50.

The flow sensor 60 may be disposed under the battery 50. The flow sensor 60 may be disposed so as to face the side surface of the lower portion of the reception space 11. A sensing hole 61 may be formed between the flow sensor 60 and the reception space 11. The flow sensor 60 may detect the flow of the air that is introduced into the cartridge 30 through the first inlet 301.

The seating portion 14 may be formed in the upper housing 13 over the battery 50. The seating portion 14 may be positioned above the dial gear 42 and the dial 43. The seating portion 14 may be positioned over the dial gear 42 and/or the dial 43 in the longitudinal direction of the rotating shaft of the dial gear 42.

A socket 80 may be mounted on one surface of the housing 10. The socket 80 may be connected to a charging terminal so as to supply power to the battery 50 and the like.

The vibration motor 90 may be received in the housing 10. The vibration motor 90 may be disposed at the lower portion of the housing 10. The vibration motor 90 may be disposed adjacent to the controller 70. The controller 70 may be disposed under the battery 50.

The controller 70 may be received in the lower portion of the housing 10. The controller 70 may be disposed under the reception space 11. The controller 70 may be electrically connected to components such as the heater 314, the rotary switch 44, the battery 50, the flow sensor 60, the socket 80, the vibration motor 90, and the like. The controller 70 may control the operation of the components, which are electrically connected thereto.

The controller 70 may control the heater 314 to heat the wick 313 to thus generate an aerosol. The controller 70 may operate the flow sensor 60. The controller 70 may control the operation of the internal components based on the information corresponding to the result of detection of air flow. The controller 70 may receive an electric signal from the rotary switch 44. The controller 70 may control the operation of the components based on the electric signal received from the rotary switch 44. The controller 70 may operate the vibration motor 90 to transmit the vibration to a user.

Referring to FIG. 4, the first container 31 may include a cylinder 310, which defines the appearance thereof. The liquid chamber 311 may be formed in the cylinder 310. The evaporation passage 318 may be formed in the cylinder 310. The evaporation passage 318 may be formed in an evaporation pipe 3180, which extends vertically. The evaporation pipe 3180 may be surrounded by the liquid chamber 311.

An evaporation housing 3120 may extends downwards from the evaporation pipe 3180. The lower portion of the evaporation housing 3120 may be enlarged radially outwards so as to be connected to the cylinder 310. The evaporation chamber 312 may be formed in the evaporation housing 3120. The evaporation chamber 312 may be connected to the evaporation passage 318 in a vertical direction.

The wick 313 may be disposed in the evaporation housing 3120. The heater 314 may be disposed in the evaporation housing 3120. The heater 314 may be wound around the wick 313 so as to surround the wick 313.

A wick hole 3121 may be formed in the evaporation housing 3120 so as to connect the liquid chamber 311 to the evaporation chamber 312. The wick 313 may be inserted into the wick hole 3121. The material for vaporization may be introduced through the wick hole 3121 so as to wet the wick 313.

A cap 36 may define the bottom surface of the cartridge 30. The cap 36 may be disposed at the lower portion of the first container 31. The cap 36 may cover the lower portion of the cylinder 310. The outer surface of the cap 36 may be rounded upwards so as to be connected to the outer circumferential surface of the cylinder 310. the outer circumferential surface of the cylinder 310 may be referred to as an outer facing surface of the cylinder 310 or an outer surface of the cylinder 310.

The first inlet 301 may be formed through the cap 36. The first inlet 301 may be connected to the evaporation chamber 312.

A first extension 362 may extend upwards from the bottom 361 of the cap 36 so as to surround the first inlet 301. The first extension 362 may define a step with respect to the bottom 361 of the cap 36.

Consequently, it is possible to prevent the material for vaporization that leaks from the liquid chamber 311 from being discharged to the outside of the cartridge 30 through the first inlet 301.

A connector 365 may extend upwards from the circumferential portion of the cap 36. The connector 365 may be fitted into the inner circumferential surface of the lower portion of the cylinder 310.

A rim 367 may extend upwards from the connector 365. The rim 367 may be spaced inwards apart from the inner circumferential surface of the cylinder 310.

A lower sealant or lower seal 37 may be disposed between the cap 36 and the evaporation chamber 312. The lower seal 37 may define the evaporation chamber 312 in conjunction with the evaporation housing 3120. An evaporation inlet 371 may be vertically formed through the lower seal 37. The evaporation inlet 371 may be positioned between the first inlet 301 and the evaporation chamber 312, and may be connected to the first inlet 301 and the evaporation chamber 312.

A second extension 372 may extend upwards from the lower seal 37 so as to surround the evaporation inlet 371. The second extension 372 may define a step with respect to the bottom surface of the lower seal 37.

Consequently, it is possible to prevent the material for vaporization that leaks from the liquid chamber 311 from being discharged to the outside of the cartridge 30 through the evaporation inlet 371 and the first inlet 301.

An upper rim 375 may extend upwards from the outer circumferential portion of the lower seal 37. A rib 3122 may extend downwards from the evaporation housing 3120. The upper rim 375 may be fitted between the rib 3122 and the inner circumferential surface of the cylinder 310.

A lower rim 377 may extend downwards from the outer circumferential portion of the lower seal 37. The lower rim 377 may be fitted between the rim 367 of the cap 36 and the inner circumferential surface of the cylinder 310.

The outer circumferential surfaces of the upper rim 375 and the lower rim 377 may define a continuous surface. The upper rim 375 and the lower rim 377 may be in contact with the inner circumferential surface of the cylinder 310. the inner circumferential surface of the cylinder 310 may be referred to as an inner facing surface of the cylinder 310 or an inner surface of the cylinder 310.

Hereinafter, the flow of air and aerosol when a user inhales air through the mouthpiece 34 will be described with reference to FIGS. 3 and 4.

When a user inhales air through the mouthpiece 34, the air may be introduced from the outside of the housing 10, and may pass through the reception space 11 between the housing 10 and the cartridge 30. The air that has passed through the reception space 11 between the housing 10 and the cartridge 30 may be introduced into the evaporation chamber 312 in the first container 31 through the first inlet 301. The introduced air may pass through the evaporation passage 318 together with the aerosol contained in the evaporation chamber 312. The aerosol that has passed through the evaporation passage 318 may be introduced into the second granulation chamber 322 sequentially through the first connecting passage 319 and the lower chamber hole 323. The aerosol may pass through the medium in the second granulation chamber 322, the upper chamber hole 324, and the first outlet 302 in that order. The aerosol that has passed through the first outlet 302 may be discharged upwards through the second inlet 341, the suction passage 343, and the second outlet 342.

Referring to FIGS. 5 and 6, the cartridge gear 41 may include an inner circumferential protrusion 416, which is inserted into the second guide slit 326. The inner circumferential protrusion 416 may project inwards from the inner circumferential surface of the cartridge gear 41. The inner circumferential protrusion 416 may be engaged with the second guide slit 326 such that the cartridge gear 41 is rotated together with the second container 32.

The second guide slit 326 may extend in the longitudinal direction of the rotating shaft of the second container 32. The second guide slit 326 may vertically guide the cartridge 30 along the inner circumferential protrusion 416. When the cartridge 30 is inserted into the reception space 11, the inner circumferential protrusion 416 may catch on the upper end of the second guide slit 326. The upper end of the second guide slit 326 may serve as a stopper configured to prevent further downward movement of the cartridge 30.

The first guide slit 316 may extend in the longitudinal direction of the second guide slit 326. The first guide slit 316 and the second guide slit 326 may define a continuous surface such that the cartridge 30 is guided vertically along the inner circumferential protrusion 416.

The mouthpiece 34 may be pivotably connected or coupled to the container head 33. FIG. 5 illustrates the state in which the mouthpiece 34 is pivoted so as to be positioned at a first position. FIG. 6 illustrates the state in which the mouthpiece 34 is pivoted so as to be positioned at a second position.

Hereinafter, the state in which the mouthpiece 34 is pivoted so as to be positioned at the first position will be described with reference to FIG. 5.

When the mouthpiece 34 is pivoted so as to be positioned at the first position, the mouthpiece 34 may be seated in the seating portion 14 so as to close the upper portion of the housing 10. The mouthpiece 34 may close the opening O in the upper case 20. One surface of the mouthpiece 34 may be exposed to the outside through the opening O.

The suction passage 343 in the mouthpiece 34 may be disposed in the upper case 20. The suction passage 343 may be oriented so as not to be aligned with the longitudinal direction of the cartridge 30.

The sealing cap 35 may project downwards from the mouthpiece 34. The sealing cap 35 may be configured to have the form of a hook. The sealing cap 35 may close the first outlet 302.

Consequently, the medium and the material for vaporization contained in the cartridge and the internal components may be protected from the external environment.

The sealing cap 35 may have an outer surface, which is rounded in the direction in which the mouthpiece 34 pivots. Accordingly, when the mouthpiece 34 is pivoted so as to be positioned at the first position, the sealing cap 35 does not catch on the surface surrounding the first outlet 302.

Next, the state in which the mouthpiece 34 is pivoted so as to be positioned at the second position will be described with reference to FIG. 6.

When the mouthpiece 34 is pivoted so as to be positioned at the second position, the mouthpiece 34 may be separated from the seating portion 14. The sealing cap 35 may be separated from the first outlet 302 so as to open the first outlet 302.

The first outlet 302 may come into contact with the second inlet 341. The suction passage 343 in the mouthpiece 34 may communicate with the first outlet 302. The suction passage 343 in the mouthpiece 34 may communicate with the space in the first container 31 and the space in the second container 32 through the first outlet 302.

The suction passage 343 may be oriented so as to extend in the longitudinal direction of the cartridge 30. The suction passage 343 may be oriented so as to extend vertically. The sealing cap 35 may be disposed so as to project toward the seating portion 14.

In summary, referring to FIGS. 1 to 6, an aerosol-generating device according to an aspect of the present disclosure includes a cartridge 30 including a first container 31 and a second container 32 includes a plurality of chambers 321 and 322, isolated from each other, and is rotatably coupled to the first container 31, a housing 10, which has a reception space 11 into which the cartridge 30 is inserted, a dial gear 42, which is disposed in the housing 10, includes a rotating shaft parallel to the rotating shaft of the second container 32, and rotatably engages with the second container 32, and a battery 50, which is disposed in the housing 10 adjacent both to the dial gear 42 and to the reception space 11 in the longitudinal direction of the rotating shaft of the dial gear 42.

In another aspect of the present disclosure, the battery 50 may be disposed at a lateral side of the reception space 11, and wherein the dial gear 42 may be disposed at the lateral side of the reception space 11 and over the battery 50.

In another aspect of the present disclosure, the aerosol-generating device may further include a cartridge gear 41, which is disposed in the housing 10 to be coaxial with the second container 32, wherein an inner circumferential surface of the cartridge gear 41 surrounds the reception space 11 and engages an outer circumferential surface of the second container 32 to rotate together with the second container 32, and wherein an outer circumferential surface of the cartridge gear 41 engages the dial gear 42 to rotate with the dial gear.

In another aspect of the present disclosure, the second container 32 may have a guide slit 326 formed in the outer circumferential surface thereof, and wherein the cartridge gear 41 may include an inner circumferential protrusion 416, which projects from the inner circumferential surface of the cartridge gear 41 and into the guide slit 326 on the second container 32.

In another aspect of the present disclosure, the guide slit 326 may extend in a longitudinal direction of the rotating shaft of the second container 32 to vertically guide the cartridge 30 along the inner circumferential protrusion 416.

In another aspect of the present disclosure, the aerosol-generating device may further include a dial 43, which is disposed in the housing 10 in the longitudinal direction of the dial gear 42 to rotate together with the dial gear 42, wherein at least a portion of the dial is exposed to the outside of the housing 10.

In another aspect of the present disclosure, the dial 43 may be disposed at an upper portion of the housing 10.

In another aspect of the present disclosure, wherein an outlet 302 is at the upper portion of the second container 32 to allow air to be discharged therethrough, wherein the aerosol-generating device further comprises: a container head 33, which is disposed over the second container 32 around the outlet 302, and a mouthpiece 34, which is pivotably coupled to the container head 33 and has a suction passage 343, wherein a seating portion 14 corresponding to a depressed portion of an upper portion of the housing is positioned over the battery 50 and has a shape corresponding to the mouthpiece 34, wherein the mouthpiece 34 is seated in the seating portion 14 to close the upper portion of the housing 10 when the mouthpiece 34 is pivoted to a first position, and the mouthpiece 34 is separated from the seating portion 14 to allow the suction passage 343 to communicate with the outlet 302 when the mouthpiece 34 is pivoted to a second position.

In another aspect of the present disclosure, the aerosol-generating device may further include a heater 314 disposed in the first container 31, and a controller 70, which is disposed under the reception space 11 and the battery 50 in the housing 10 and is configured to control the operation of the heater 314.

In another aspect of the present disclosure, the aerosol-generating device may further include a rotary switch 44, which is disposed over the battery 50 and is configured to detect the position of the dial gear 42.

In another aspect of the present disclosure, the aerosol-generating device may further include a flow sensor 60, which is disposed under the battery 50 to face the side surface of a lower portion of the reception space 11, and is configured to detect the flow of air introduced into the cartridge 30.

In another aspect of the present disclosure, an aerosol-generating device includes a cartridge 30, which has an outlet 302 at the upper portion thereof, through which air is discharged, a container head 33, which is disposed on the container to surround the outlet 302, and a mouthpiece 34, which is pivotably coupled to the container head 33 and has a suction passage 343, a housing 10, which has a reception space 11 into which the cartridge 30 is inserted, and a battery 50, which is disposed in the housing 10 parallel to the cartridge 30, wherein a seating portion 14 corresponding to a depressed portion of an upper portion of the housing is positioned over the battery 50 and has a shape corresponding to the mouthpiece 34, wherein the mouthpiece 34 is seated in the seating portion 14 to close the upper portion of the housing 10 when the mouthpiece 34 is pivoted to a first position, and wherein the mouthpiece 34 is separated from the seating portion 14 to allow the suction passage 343 to communicate with the outlet 302 when the mouthpiece 34 is pivoted to a second position.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An aerosol-generating device comprising:

a cartridge including a first container and a second container, wherein the second container includes a plurality of chambers isolated from each other, and is rotatably coupled to the first container such that the plurality of chambers are rotatable relative to the first container;

a housing, which has a reception space into which the cartridge is inserted;

a dial gear, which is disposed in the housing, includes a rotating shaft parallel to a rotating shaft of the second container, and rotatably engages with the second container; and a battery, which is disposed in the housing adjacent both to the dial gear and to the reception space in a longitudinal direction of the rotating shaft of the dial gear.

2. The aerosol-generating device according to claim 1, wherein the battery is disposed at a lateral side of the reception space, and wherein the dial gear is disposed at the lateral side of the reception space and above the battery.

3. The aerosol-generating device according to claim 1, further comprising a cartridge gear, which is disposed in the housing to be coaxial with the second container, wherein an inner circumferential surface of the cartridge gear surrounds the reception space and engages an outer circumferential surface of the second container to rotate together with the second container, and wherein an outer circumferential surface of the cartridge gear engages the dial gear to rotate with the dial gear.

4. The aerosol-generating device according to claim 3, wherein the second container has a guide slit formed at an outer circumferential surface thereof, and wherein the cartridge gear includes an inner circumferential protrusion, which projects from the inner circumferential surface of the cartridge gear and into the guide slit.

5. The aerosol-generating device according to claim 4, wherein the guide slit extends in a longitudinal direction of the rotating shaft of the second container to vertically guide the cartridge along the inner circumferential protrusion.

6. The aerosol-generating device according to claim 1, further comprising a dial, which is disposed in the housing in the longitudinal direction of the rotating shaft of the dial gear to rotate together with the dial gear, wherein at least a portion of the dial is exposed to an outside of the housing.

7. The aerosol-generating device according to claim 6, wherein the dial is disposed at an upper portion of the housing.

8. The aerosol-generating device according to claim 1, wherein an outlet is at an upper portion of the second container to allow air to be discharged therethrough, wherein the aerosol-generating device further comprises:

a container head, which is disposed over the second container around the outlet; and a mouthpiece, which is pivotably coupled to the container head and has a suction passage, wherein a seating portion corresponding to a depressed portion of an upper portion of the housing is positioned over the battery and has a shape corresponding to the mouthpiece, wherein the mouthpiece is seated in the seating portion to close the upper portion of the housing when the mouthpiece is pivoted to a first position, and the mouthpiece is separated from the seating portion to allow the suction passage to communicate with the outlet when the mouthpiece is pivoted to a second position.

9. The aerosol-generating device according to claim 1, further comprising:

a heater disposed in the first container; and a controller, which is disposed under the reception space and the battery in the housing, and is configured to control an operation of the heater.

10. The aerosol-generating device according to claim 1, further comprising a rotary switch, which is disposed over the battery and is configured to detect a position of the dial gear.

11. The aerosol-generating device according to claim 1, further comprising a flow sensor, which is disposed under the battery to face a side surface of a lower portion of the reception space, and is configured to detect a flow of air introduced into the cartridge.

* * * * *